US010016873B2

(12) United States Patent
Fang et al.

(10) Patent No.: US 10,016,873 B2
(45) Date of Patent: Jul. 10, 2018

(54) DIAMOND ENHANCED INSERT WITH CONTROLLED DIAMOND FRAME STRENGTH

(71) Applicant: SMITH INTERNATIONAL, INC., Houston, TX (US)

(72) Inventors: Yi Fang, Orem, UT (US); Haibo Zhang, Lindon, UT (US); J. Daniel Belnap, Lindon, UT (US)

(73) Assignee: SMITH INTERNATIONAL, INC., Houston, TX (US)

( * ) Notice: Subject to any disclaimer, the term of this patent is extended or adjusted under 35 U.S.C. 154(b) by 207 days.

(21) Appl. No.: 14/949,520

(22) Filed: Nov. 23, 2015

(65) Prior Publication Data

US 2016/0144482 A1 May 26, 2016

Related U.S. Application Data

(60) Provisional application No. 62/082,956, filed on Nov. 21, 2014.

(51) Int. Cl.

| | |
|---|---|
| ***B24D 3/10*** | (2006.01) |
| ***E21B 10/46*** | (2006.01) |
| ***E21B 10/55*** | (2006.01) |
| ***E21B 10/567*** | (2006.01) |
| ***B24D 18/00*** | (2006.01) |
| ***B24D 99/00*** | (2010.01) |
| ***E21B 10/573*** | (2006.01) |

(52) U.S. Cl.

CPC ..... *B24D 3/10* (2013.01); *B24D 18/0009* (2013.01); *B24D 99/005* (2013.01); *E21B 10/46* (2013.01); *E21B 10/55* (2013.01); *E21B 10/567* (2013.01); *E21B 10/5735* (2013.01)

(58) Field of Classification Search

CPC .... E21B 10/46; E21B 2010/545; E21B 10/55; E21B 2010/561; E21B 10/567; B24D 3/10

See application file for complete search history.

(56) References Cited

U.S. PATENT DOCUMENTS

| | | | | |
|---|---|---|---|---|
| 2002/0043407 | A1* | 4/2002 | Belnap | C04B 35/111 175/374 |
| 2006/0266559 | A1* | 11/2006 | Keshavan | B01J 3/062 175/428 |
| 2012/0261196 | A1 | 10/2012 | Yu et al. | |
| 2015/0292271 | A1 | 10/2015 | Yu et al. | |

* cited by examiner

*Primary Examiner* — Cathleen R Hutchins

(57) ABSTRACT

A Diamond Enhanced Insert (DEI) includes a working layer of a polycrystalline diamond material (PCD). The PCD material includes a first phase that includes a number of particles of a first material. The PCD material also includes a second phase that is adapted as a catalyst. The PCD material has a fracture toughness greater than 12.5 MPa·√m, a flexural strength of greater than 800 MPa, and a diamond frame strength of less than 400 MPa.

19 Claims, 11 Drawing Sheets

DIAMOND ENHANCED INSERT WITH CONTROLLED DIAMOND FRAME STRENGTH

BACKGROUND

Hydrocarbon fluids such as oil and natural gas are obtained from a subterranean geologic formation by drilling a well that penetrates the hydrocarbon-bearing formation. Once a wellbore is drilled, various forms of well completion components may be installed in order to control and enhance the efficiency of producing the various fluids from the reservoir.

Wellbores are frequently drilled using boring tools that break up rock or hard sections of the geological formation by mechanical action. Mechanical actions may include, for example, striking, gouging, or shearing. Due to the violent nature of mechanical actions, working surfaces of boring tools naturally degrade over time. To minimize degradation of the working surfaces of boring tools over time, the working surface is adapted depending on the type of mechanical action that the boring tool is expected to perform. Similar degradation of boring tools occurs in other drilling applications such as making blast holes for mining applications.

Working surfaces of some boring tools are a polycrystalline diamond (PCD) material known in the art for having a high degree of wear resistance. PCD materials that are known in the art are formed by compacting a powder including diamond grains and a catalyst into a green form that is then subjected to a high temperature, high pressure sintering process. Sintering at high temperature and high pressure activates the catalyst in the powder which in turn creates inter-diamond grain bonds and adheres the sintered PCD material to the boring tool. The sintered PCD material contains a microstructure of randomly oriented diamond crystals bonded together to form a diamond matrix phase and a plurality of interstitial regions interposed between the diamond crystals.

The material properties of a PCD material, such as fracture toughness or transverse rupture strength, are contributed to by both the diamond matrix phase and the residual catalyst material located in interstitial regions. However, measurements of bulk properties of a PCD material may hide information about the PCD material. For example, a PCD material including diamond grains that are very strongly bonded and a second phase that is weakly bonded may appear to have a transverse rupture strength that is the same as a PCD material that includes diamond grains that are weakly bonded and a second phase that is very strongly bonded.

Conventional wisdom from what is known in the art suggests that maximizing both the fracture toughness and flexural strength minimizes boring tool wear over time. However, the aforementioned suggestions only consider a limited number of potential failure mechanisms and does not consider how individual phases of PCD materials contribute to failure mechanisms. Improvements in PCD materials that take into account additional failure mechanisms may decrease tool wear and improve tool life.

SUMMARY

In one aspect, a Diamond Enhanced Insert (DEI) according to one or more embodiments may include a working layer of a polycrystalline diamond material (PCD). The PCD material may include a first phase that includes a number of particles of a first material. The PCD material may also include a second phase that is adapted as a catalyst. The PCD material may have a fracture toughness greater than 12.5 MPa·√m, a flexural strength of greater than 800 MPa, and a diamond frame strength of less than 400 MPa.

In another aspect, a method of forming a DEI may include compacting a powder mixture that includes a first phase of a plurality of diamond grains and a second phase adapted as a catalyst to form a green composite. The green composite may be sintered to form a PCD material.

BRIEF DESCRIPTION OF DRAWINGS

Certain embodiments will be described with reference to the accompanying drawings. However, the accompanying drawings illustrate only certain aspects or implementations by way of example and are not meant to limit the scope of the claims.

DETAILED DESCRIPTION

Figure 1:
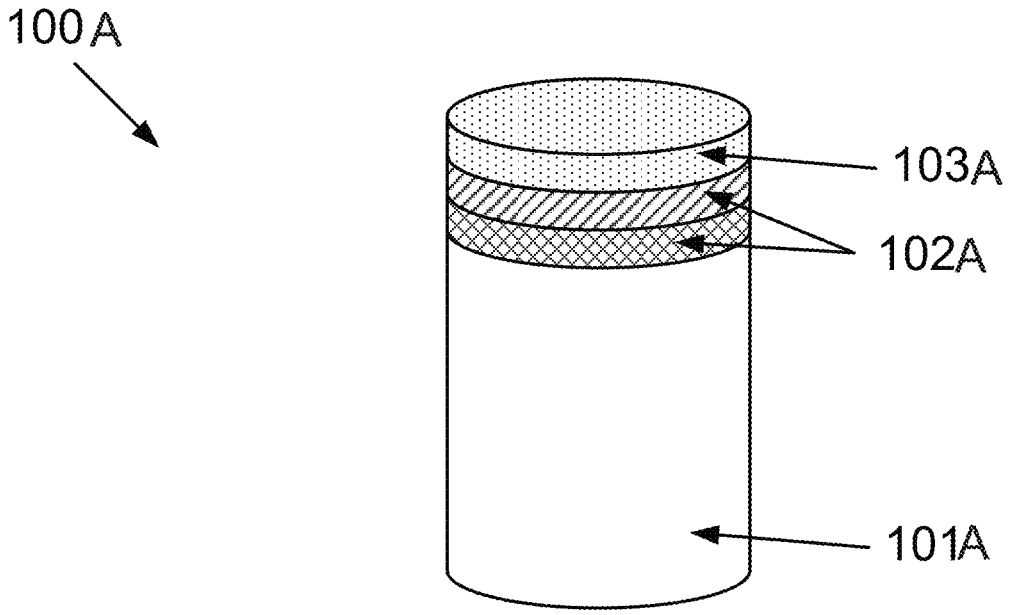
FIG. 1 (A) (Prior Art)
FIGS. 1(A)-(B) show a perspective view of a Diamond Enhanced Insert (DEI).
Figure 1:
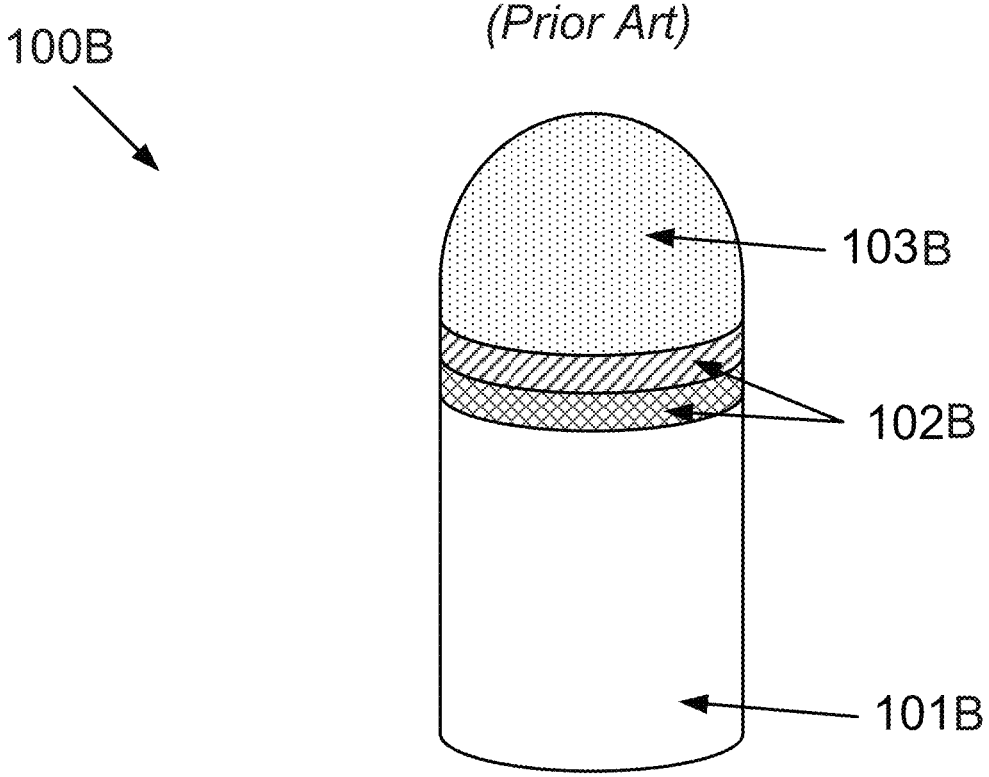
FIG. 1 (B) (Prior Art)

Specific embodiments will now be described with reference to the accompanying figures. In the following description, numerous details are set forth as examples. It will be understood by those skilled in the art that one or more embodiments of the present invention may be practiced without these specific details and that numerous variations or modifications may be possible without departing from the scope. Certain details known to those of ordinary skill in the art are omitted to avoid obscuring the description.

In the following description and in the claims, the terms "including" and "comprising" are used in an open ended fashion, and thus, should be interpreted to mean "including, but not limited to."

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, quantities, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of 1 to 4.5 should be interpreted to include not only the explicitly recited limits of 1 to 4.5, but also include individual numerals such as 2, 3, 4, and sub-ranges such as 1 to 3, 2 to 4, etc. The same principle applies to ranges reciting only one numerical value, such as "at most 4.5," which should be interpreted to include all of the above-recited values and ranges. Further, such an interpretation should apply regardless of the breadth of the range or the characteristic being described.

When using the term "different" in reference to materials used, it is to be understood that this includes materials that generally include the same constituents, but may include different proportions of the constituents and/or that may include differently sized constituents, wherein one or both operate to provide a different mechanical and/or thermal property in the material. The use of the terms "different" or "differ" are not meant to include typical variations in manufacturing unless otherwise specified.

Diamond Enhanced Inserts (DEIs) are replaceable components of boring tools that include a working layer. When a working layer on a DEI fails, the DEI may be removed and replaced to renew a working layer on a boring tool. DEIs strike or gouge geological formations to break the geological formations as opposed to cutters that shear geological formations. Working layers of DEIs sometimes use PCD material to provide wear resistance of the working layer.

FIGS. 1A-B show a diagram of DEIs that includes a working layer formed from a PCD material. Specifically, FIG. 1A shows a first example DEI 100A and FIG. 1B shows a second example DEI 100B. The DEIs 100A/B includes an attachment body 101A/B that attaches to a receptacle on a boring tool (not shown). In some cases, the DEI 100A/B also includes one or more transition layers 102A/B that facilitates attachment of a working layer 103A/B to the attachment body 101A/B while in others no transition layers 102A/B are present. The DEI 100A/B further includes the working layer 103A/B. The working layer 103A/B may be a PCD material. In FIG. 1A the working layer 103A is illustrated as a disc and in FIG. 1B the working layer 103B is illustrated as a hemisphere stacked on a cylinder, however the shape of a working layer may include shapes and contours other than those depicted. As can be seen from the two figures, different geometries of working layers 103A and 103B, different numbers and types of transitions layers 102A/B, and different materials may all be used in accordance with the knowledge of a person of ordinary skill in the art.

Under some drilling conditions, DEIs 100A/B including a working layer 103A/B of a PCD material have been found to fail catastrophically even when the fracture toughness and transverse rupture strength of the PCD material are large. Accordingly, an investigation was made to identify the cause of the catastrophic failure of PCD materials used in DEIs.

Figure 2:
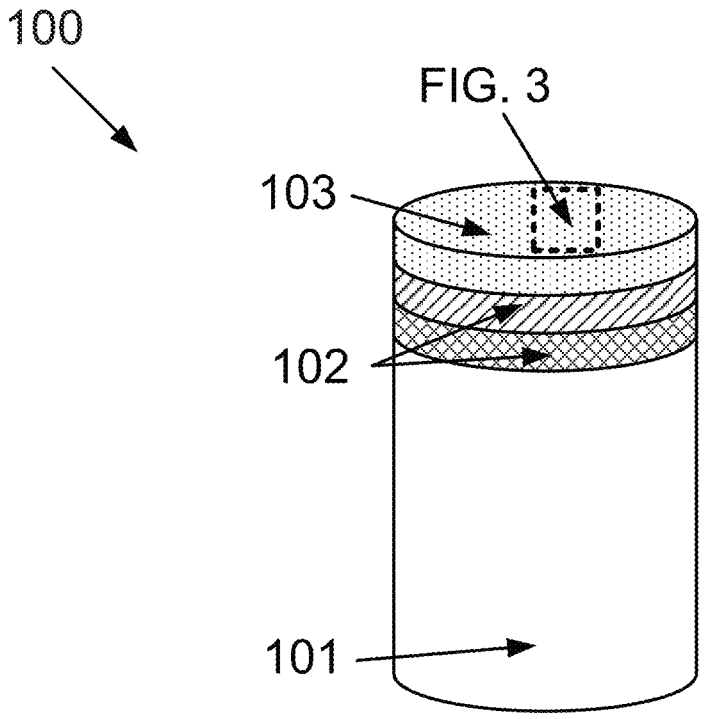
FIG. 2 (Prior Art)
FIG. 2 shows a specific area of a DEI.
Figure 3:
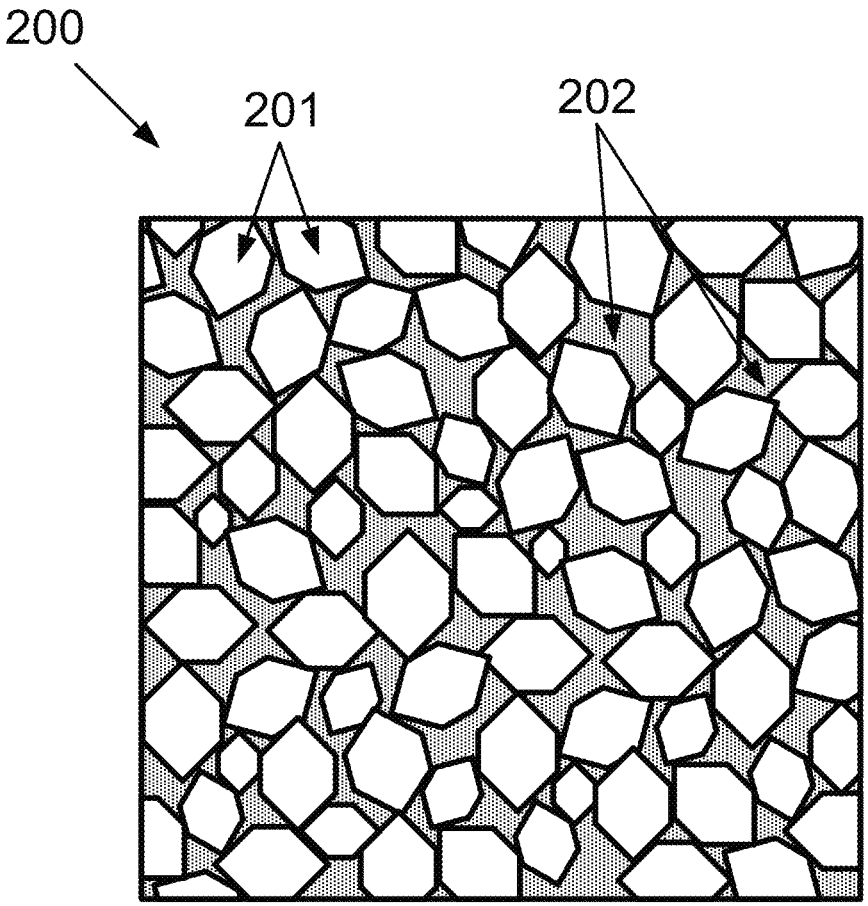
FIG. 3 (Prior Art)
FIG. 3 shows a cross section of the microstructure of an example Polycrystalline Diamond (PCD) material.

FIGS. 2 and 3 show a diagram of the microstructure of an example PCD material 200 used in a DEI 100 that has been found to catastrophically fail. Specifically, FIG. 2 shows a location on a DEI 100 in dashing and FIG. 3 shows the microstructure of the PCD material 200 at the location. The PCD material 200 is formed to maximize fracture toughness and transverse rupture strength according to what was previously known in the art. The PCD material 200 includes a first phase 201 and a second phase 202. The first phase 201 includes a number of diamond grains that impart fracture strength to the PCD material. The diamond grains of the first phase 201 are drawn as six sided shapes but are mere illustrations; in practice, diamond grains may be any shape and dispersed in size. The second phase 202 includes a catalyst that caused bonds to form between diamond grains in the first phase 201 and adhere the PCD material 200 to the DEI 100.

As part of the investigation, measurements of the material properties of individual phases of PCD materials were carried out. It was determined that the flexural strength of the PCD material after leaching out the majority of the second phase, also called the diamond frame strength, contributed to catastrophic failure of PCD materials 200. The diamond frame strength measures the strength of the sintered, bonded-together diamond grains that form the PCD material, without contribution of the secondary catalyst phase. The diamond frame is the microstructure of bonded diamond grains themselves.

Figure 4:
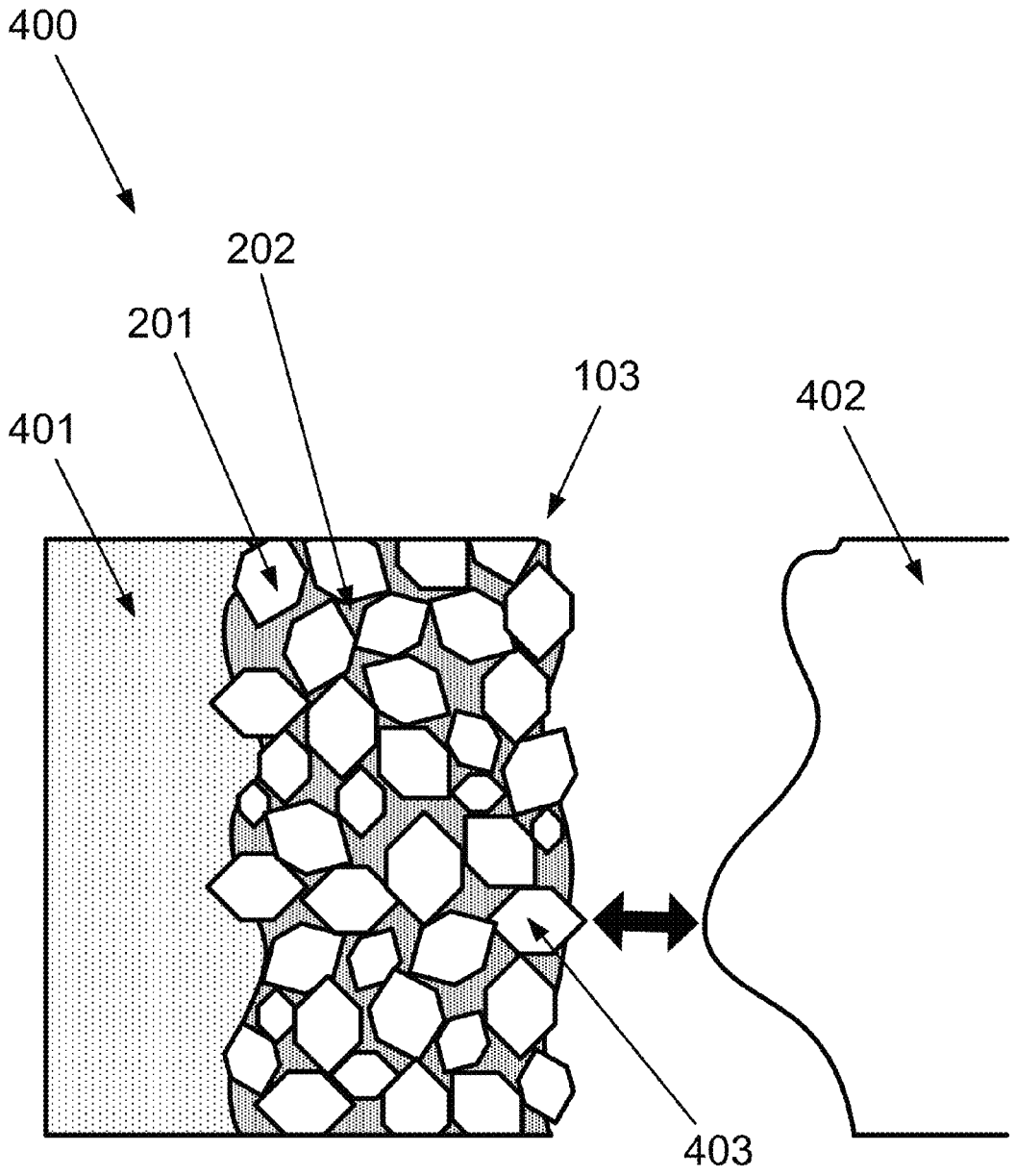
FIG. 4 (Prior Art)
FIG. 4 shows a perspective view of a DEI interacting with a geological formation.

Careful analysis has led to the identification of the failure mechanism that caused the PCD materials 200 to fail. The failure mechanism was found to be crack propagation within the PCD material. The identified failure mechanism is illustrated by way of example in FIGS. 4-7. FIG. 4 shows an example use of a DEI 400 that may cause a crack to form and propagate. Specifically, FIG. 4 shows a working layer 103 attached to a DEI 401 striking or gouging a geological formation 402. The black double sided arrow indicates a particular section of the geological formation 402 being impacted by a particular diamond grain 403 within the PCD material 200 of the working layer 103. A crack may be initiated by normal use of the DEI 100.

Figure 5:
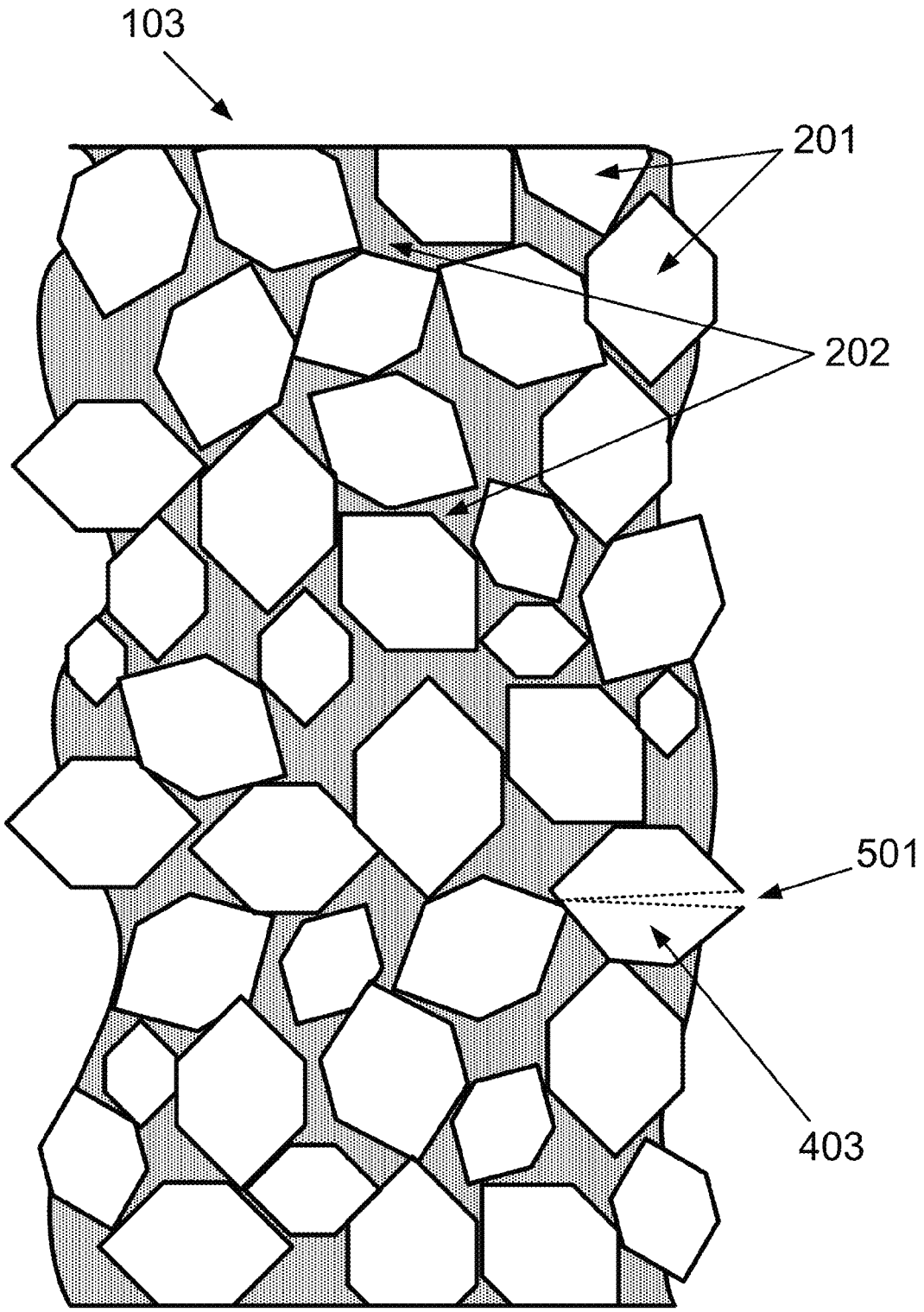
FIG. 5 (Prior Art)
FIG. 5 shows a cross section of an example of a crack in a PCD material.

FIG. 5 shows an example of a crack 501 within a particular diamond grain 403 of the working layer 103 of the DEI 100. Specifically, FIG. 5 shows the initiation of a crack 501 in a working layer 103 of a PCD material 200 that has a diamond frame strength of more than 400 MPa. The crack 501 propagates along the diamond grain and results in fracturing of the diamond grain.

Figure 6:
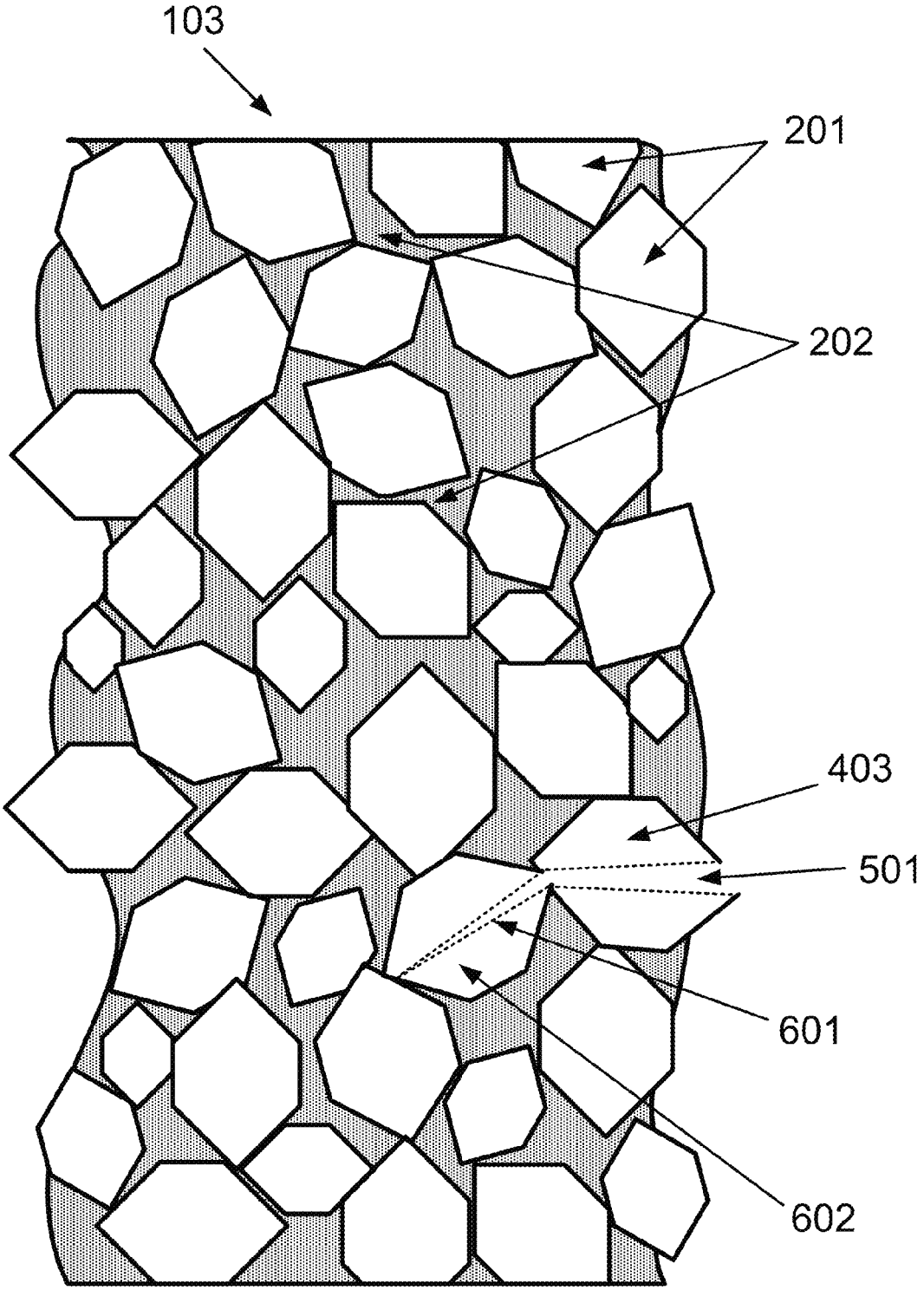
FIG. 6 (Prior Art)
FIG. 6 shows a cross section of an example of a crack propagating in a PCD material.

FIG. 6 shows an example of propagation of the crack 501. Specifically, due to the diamond frame strength of greater than 400 MPa of the PCD material 200, the crack 501 propagated within adjoining diamond grains 602 within the PCD material 200 which resulted in adjoining diamond grains 602 to crack 601. By propagating within diamond grains, the crack 501 weakened the local structural integrity of the entire area surrounding the crack 501.

Figure 7:
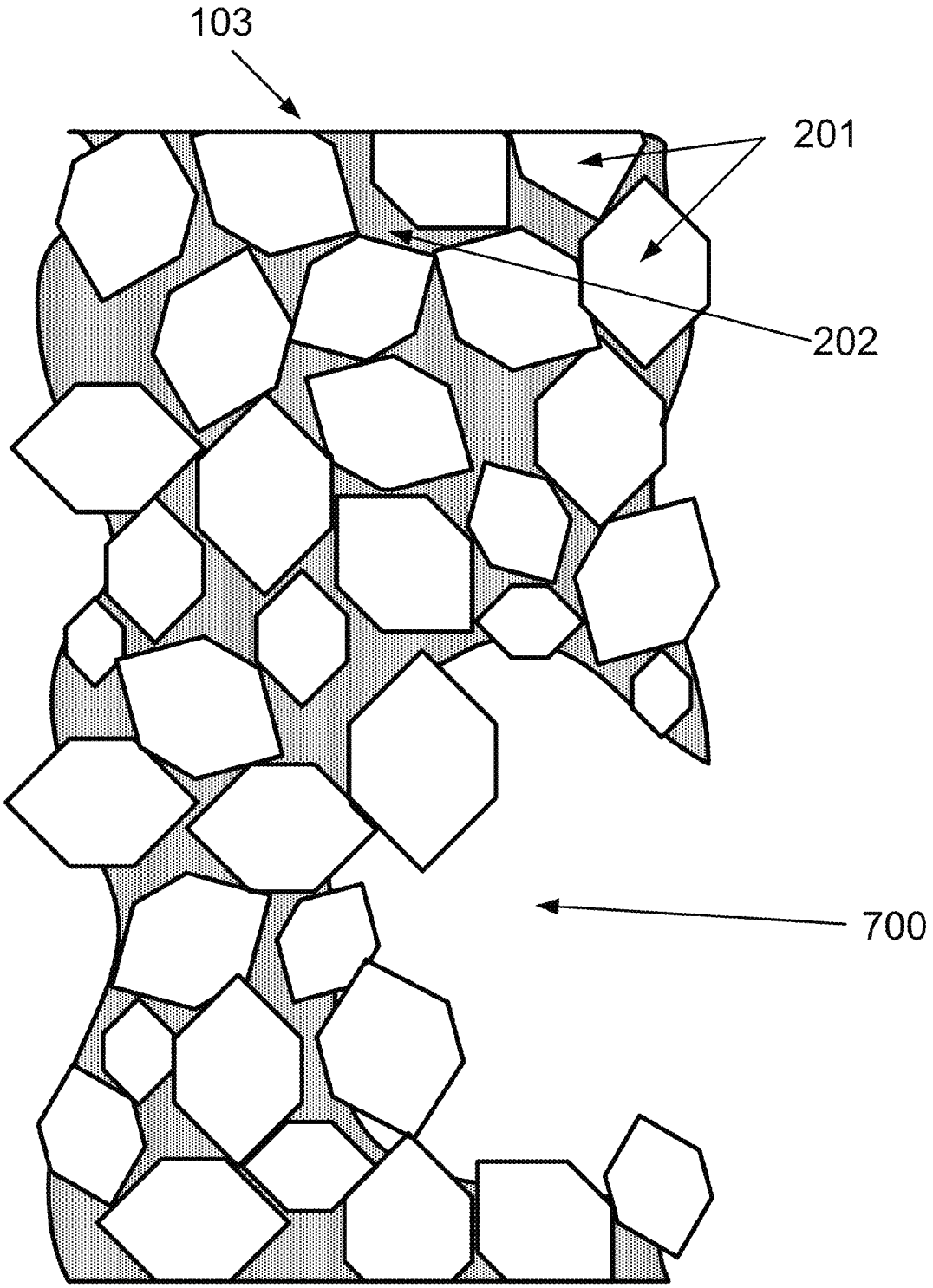
FIG. 7 (Prior Art)
FIG. 7 shows a cross section of an example of a catastrophic failure of a PCD material.

FIG. 7 shows an example of a potential catastrophic failure of continuing to the use the DEI 100 after a crack 501 propagates within adjoining diamond grains 602. A large portion of the working layer 103 broke away and left a void 700. Further, the void structurally weakened the portion of the working layer above and below the void which in turn may break away from the working layer 103.

In view of the newly identified failure mechanism, further investigation was conducted to identify methods of preventing catastrophic failure of DEIs while still providing sufficient wear resistance. The further investigation identified a specific range of material properties that prevented the newly identified failure mechanism from destroying a DEI while providing sufficient wear resistance for DEI applications. Specifically, it was found through investigation that setting the transverse rupture strength to greater than 800

MPa while keeping the diamond frame strength of the PCD material to a specific range of less than 400 MPa prevented catastrophic failure of DEIs and provided sufficient wear resistance for DEIs incorporating the PCD material to be used for wear resistant applications. PCD materials that have a transverse rupture strength of greater than 800 MPa and a diamond frame strength of less than 400 MPa are here forth referred to as Controlled Diamond Frame Strength PCD (CDFSPCD) materials.

Thus, embodiments relate to catastrophic failure resistant DEIs for boring tools and methods of forming catastrophic failure resistant DEIs. Specifically, catastrophic failure resistant DEIs may incorporate a CDFSPCD material. In one or more embodiments, a catastrophic failure resistant DEI includes a working layer of a CDFSPCD material. The CDFSPCD material is engineered to have a diamond frame strength of less than 400 MPa. In one or more embodiments, the diamond frame strength of the CDFSPCD material is engineered to be greater than 100 MPa. In one or more embodiments, engineering the diamond frame strength of the CDFSPCD material prevents catastrophic failure of the DEI.

Figure 8:
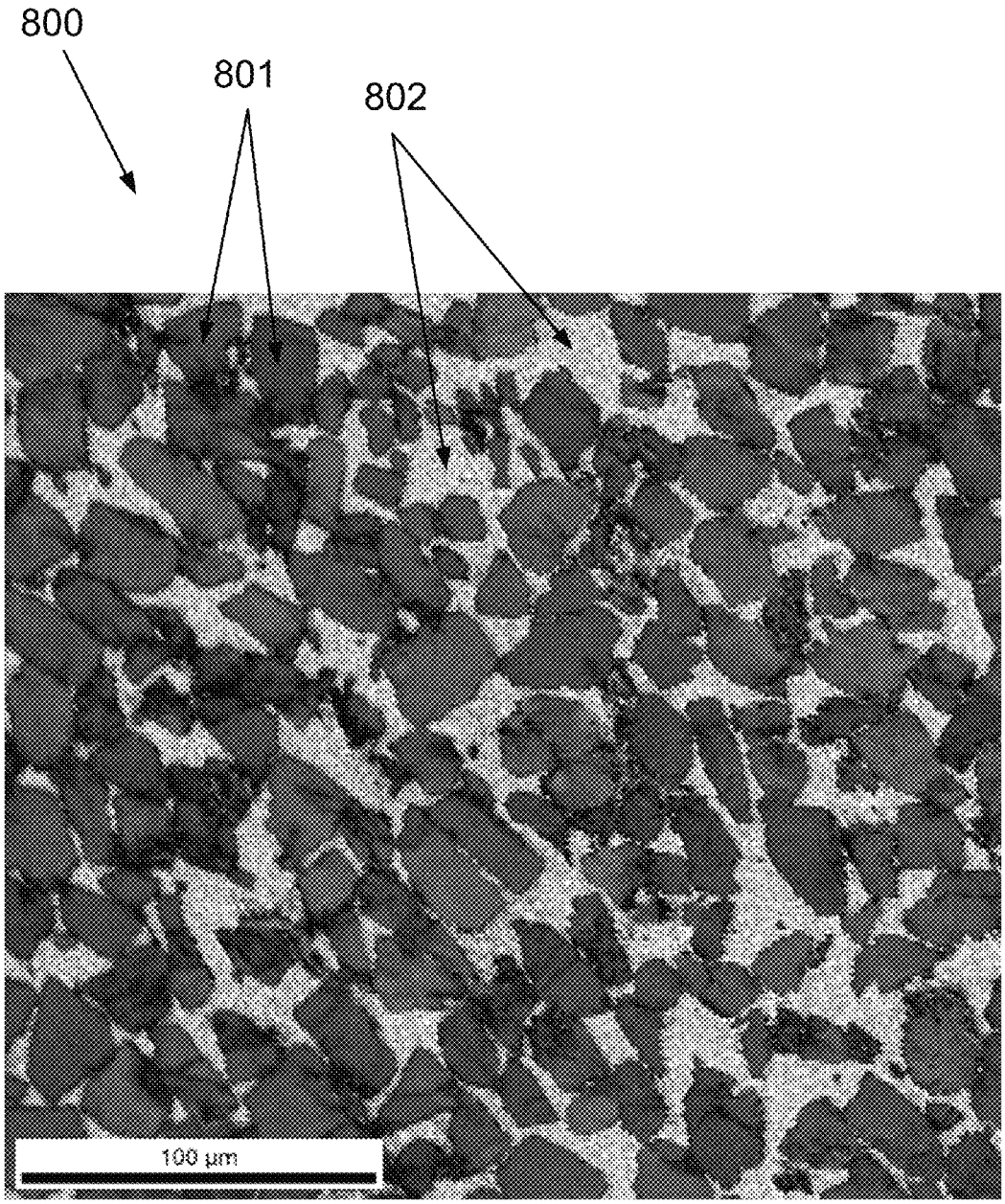
FIG. 8 shows a Scanning Electron Microscope (SEM) image of a cross section of the microstructure of a catastrophic failure resistant PCD material in accordance with one or more embodiments.

FIG. 8 shows a scanning electron microscope image of the microstructure of a CDFSPCD material 800 according to one or more embodiments. The CDFSPCD material 800 includes a first phase 801 and second phase 802. In one or more embodiments, the first phase 801 has a volume fraction of between 0.65-0.75 and the second phase 802 has a volume fraction of between 0.25-0.35. In one or more embodiments, the first phase 801 includes diamond grains larger than 30 microns in average particle size and are uniformly dispersed with the second phase 802.

The CDFSPCD material 800 further includes a second phase 802 that includes a catalyst material. In one or more embodiments, the second phase 802 includes 10-20 wt % cobalt and 80-90 wt % tungsten carbide. The ratio of the first phase 801 to the second phase 802 decreases the diamond frame strength of the CDFSPCD material 800 to less than 400 MPa. In one or more embodiments, the diamond frame strength is less than 400 MPa and greater than 100 MPa. In one or more embodiments, the CDFSPCD material 800 has a fracture toughness greater than 12.5 MPa·√m and diamond frame strength of less than 400 MPa.

Engineering the diamond frame strength of the CDFSPCD material 800 to the specific range of less than 400 MPa is believed to alter crack propagation behavior which in turn prevents catastrophic failure. Specifically, by having relatively weak diamond-diamond bonding through engineering the CDFSPCD material to have a flexural strength greater than 800 MPa and a diamond frame strength to be less than 400 MPa is believed to cause cracks to preferentially propagate along the grain boundaries of diamond grains rather than through diamond grains. That is, in an embodiment, by designing a material having a comparatively lower diamond frame strength, a path within adjoining diamond grains becomes less preferred because it is a higher energy facture path as compared to a path along matrix-diamond interfaces. By propagating along the diamond grain boundary, cracks are isolated to a single diamond grain and only weaken a very small fraction of the CDFSPCD material 800 when compared to a crack that propagates through multiple diamond grains as shown in FIGS. 3-7.

Figure 9:
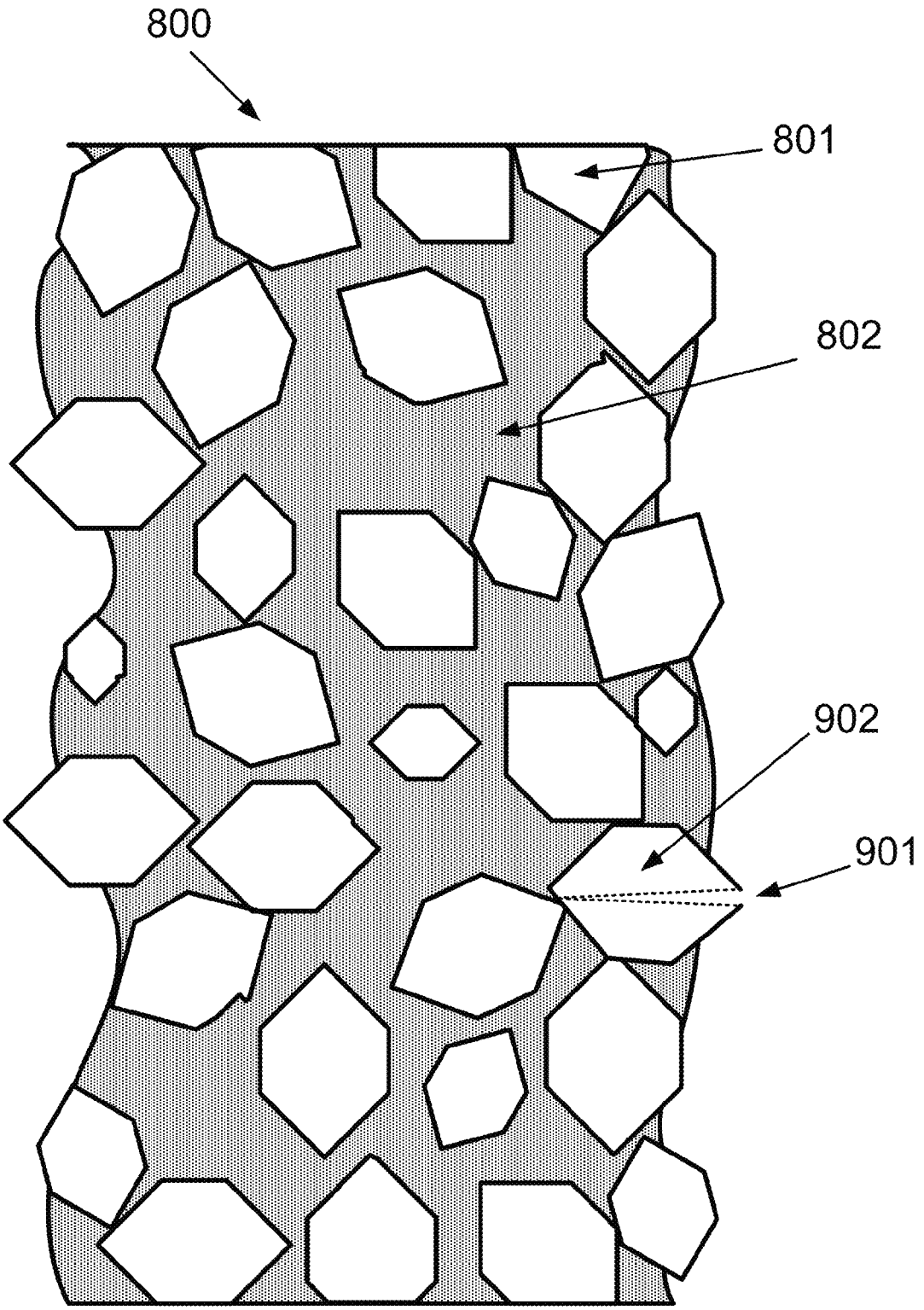
FIG. 9 shows a cross section of the microstructure of a crack in a catastrophic failure resistant PCD material in accordance with one or more embodiments.
Figure 10:
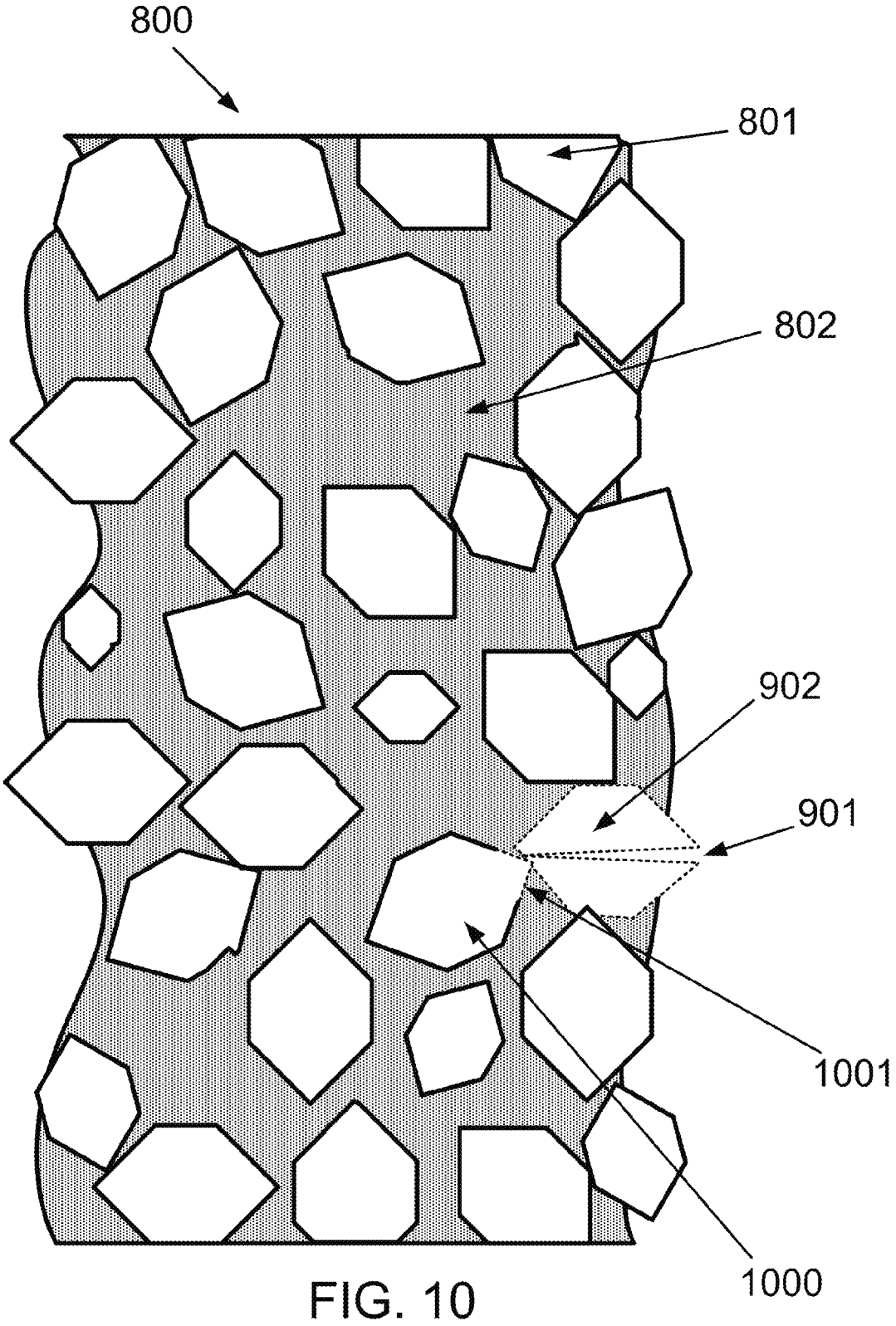
FIG. 10 shows a cross section of the microstructure of a crack propagating in a catastrophic failure resistant PCD material in accordance with one or more embodiments.

FIGS. 9 and 10 illustrate the initiation and propagation of a crack in a CDFSPCD material 800. The crack is believed to propagate substantially differently than in PCD materials 200 that have a diamond frame strength of greater than 400 MPa. Different propagation mechanics are believed to prevent catastrophic failure of CDFSPCD materials 800 and in turn DEIs that incorporate working layers of CDFSPCD materials.

FIG. 9 shows a cross section of the microstructure of a CDFSPCD material 800 incorporated into a working layer of a DEI including a crack 901 within a specific diamond grain 902. The crack 901 propagated within the specific diamond grain 902 and caused the specific diamond grain 902 to fracture. Cracking is indicated by dashed lines.

FIG. 10 shows a cross section of the microstructure of a CDFSPCD material 800 including the propagation of the crack 901 after fracturing the specific diamond grain 902. Specifically, due to the diamond frame strength of greater than 100 MPa and less than 400 MPa of the CDFSPCD material 800, the crack 901 propagated along the boundary 1001 between the specific diamond grain 902 and an adjoining diamond grain 1000 within the CDFSPCD material 800. By propagating along the boundary 1001, the crack 901 only weakened the inter-diamond bonds, facilitated by the second phase 802, of the specific diamond grain 902 that was cracked. Cracking along the boundary 1001 is indicated by dashed lines. By only weakening the specific diamond grain 901, catastrophic failure of the CDFSPCD material 800 was prevented which in turn prevented the working layer of the DEIs incorporating CDFSPCD materials 800 from catastrophically failing.

Weakening the diamond frame strength of a PCD material to improve durability is entirely counterintuitive to what was previously known in the art. The durability of a PCD material was commonly assumed to be predicted by the fracture toughness and transverse rupture strength of the PCD material. Increasing either the fracture toughness or the transverse rupture strength was assumed to improve durability by decreasing the potential for diamond grains to chip or break away from a working layer of a DEI incorporating a PCD material during normal use. However, the investigation has shown that, in fact, reducing the diamond frame strength of a PCD material substantially improves the durability of working layers in DEI. This is counterintuitive because it shows that weakening a certain portion of the PCD material, in this case the inter-diamond bonds by reducing the diamond frame strength, improved the overall durability of the PCD material.

The investigation revealed that by weakening inter-diamond bonds, by reducing the diamond frame strength of a PCD material, crack propagation within the PCD material was substantially changed. When loads were applied to a PCD material that fractured diamond grains, cracks propagated along grain boundaries which isolated the cracks. Isolating the cracks, in turn, prevented catastrophic failure of the working layer of the DEI incorporating the PCD material.

Figure 11:
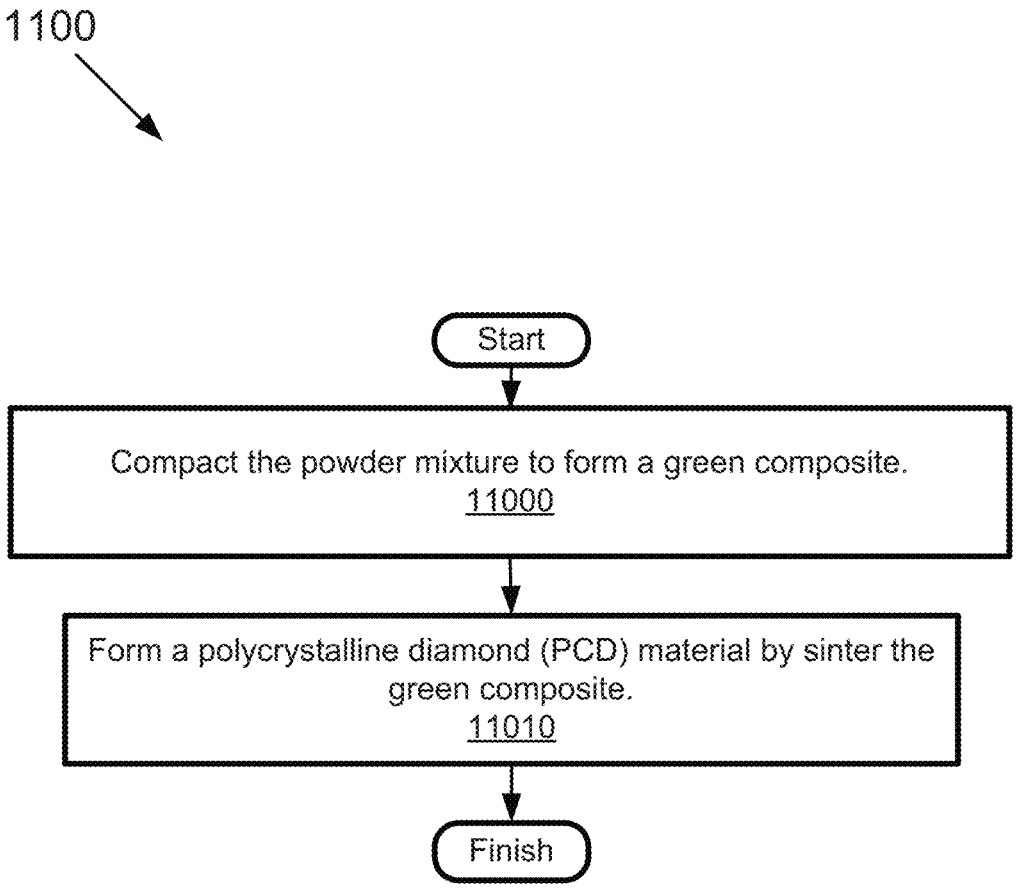
FIG. 11 shows a method of forming a catastrophic failure resistant DEI in accordance with one or more embodiments.

FIG. 11 shows a flowchart 1100 for forming a CDFSPCD material 800 according to one or more embodiments. One or more items shown in FIG. 11 may be omitted, repeated, and/or performed in a different order among different embodiments.

At 11000, a powder mix is compacted to form a green composite. The powder mix includes a first phase that includes a number of particles of a first material. In one or more embodiments, the first phase includes diamond grains larger than 30 microns in average particle size. For example, the diamond grain size distribution may be: 5% or more of the diamond grains are greater than 25 microns, 50% of the diamond grains are between 33 and 37 microns, and 95% or less of the diamond grains are less than 45 microns. The powder mix also includes a second phase adapted as a catalyst. In one or more embodiments, the second phase includes 10-20 wt % cobalt and 80-90 wt % tungsten carbide. In one or more embodiments, the first phase 801 has a volume fraction of between 0.65-0.75 and the second phase 802 has a volume fraction of between 0.25-0.35. In one or more embodiments, powder is compacted by isostatic pressing. In one or more embodiments, the powder mix may be compacted onto a transition layer 102 as shown in FIG. 1. In one or more embodiments, the powder mix is compacted onto an attachment body 101 and no transition layers 102 are present.

At 11010, the green composite is sintered to form a PCD material. In one or more embodiments, the sintering may include a high temperature, high pressure process. During sintering, the second phase acts as a catalyst to facilitate bonds between particles of the first phase. In one or more embodiments, sintering the green composite causes a number of inter-diamond-grain bonds to form between a number of diamond grains. In one or more embodiments, the number of inter-diamond-grain bonds imparts fracture toughness and diamond frame strength to the PCD material.

The second phase further acts as an inter-diamond-grain bond limiting agent. To form inter-diamond-grain bonds, the catalyst is placed between two diamond grains that are in close proximity. As the quantity of second phase increases, the average spacing between diamond grains increases and in turn decreases the chance of forming an inter-diamond-grain bond. Thus, increasing the proportion of the second phase decreases the number of inter-diamond-grain bonds formed which reduces the diamond frame strength.

In one or more embodiments, the second phase also acts as a catalyst to adhere the PCD material to the DEI, e.g. to the attachment body or a transition layer. In one or more embodiments, the sintered PCD material has a fracture toughness greater than 12.5 MPa·√m, a Transverse Rupture Strength (TRS) of greater than 800 MPa, and a diamond frame strength of less than 400 MPa.

A DEI according to one or more embodiments may provide one or more of the following advantages. A DEI according to one or more embodiments provides a longer working life before degradation when compared to DEIs known heretofore. Further, a DEI according to one or more embodiments prevents catastrophic failure of the DEI due to crack propagation within diamond grains. In a recent field test a DEI incorporating a CDFSPCD material was able to drill over 450 meters in percussive drilling of hard rock while resisting catastrophic failure, in comparison to a traditional tungsten carbide percussive drill bits became dull after 10-20 meters. Traditional PCD materials in this application have failed catastrophically at much less than 450 meters.

While the invention has been described above with respect to a limited number of embodiments, those skilled in the art, having the benefit of this disclosure, will appreciate that other embodiments can be devised which do not depart from the scope as disclosed herein. Accordingly, the scope should be limited by just the attached claims.

What is claimed is:

1. A Diamond Enhanced Insert (DEI), comprising:

a working layer of a polycrystalline diamond (PCD) material comprising:

a first phase comprising a plurality of particles of a first material, a second phase comprising a catalyst, wherein a fracture toughness of the PCD material is greater than 12.5 MPa·√m, a flexural strength of the material is greater than 800 MPa, and a diamond frame strength of the PCD material is less than 400 MPa.

2. The DEI according to claim 1, wherein the diamond frame strength of the PCD material is less than 400 MPa and greater than 100 MPa.

3. The DEI according to claim 1, the first phase further comprising:

a plurality of inter-particle bonds, facilitated by the second phase, between the plurality of particles that impart fracture toughness and diamond frame strength to the working layer.

4. The DEI according to claim 1, wherein the plurality of particles of a first material comprises diamond grains of an average particles size of greater than 30 microns.

5. The DEI according to claim 1, wherein the second phase comprises less than 10% by weight cobalt and more than 90% by weight tungsten carbide.

6. The DEI according to claim 1, wherein the second phase comprises less than 20% by weight cobalt and more than 80% by weight tungsten carbide.

7. The DEI according to claim 1, wherein the first phase occupies greater than 75% by volume of the working layer and the second phase occupies less than 25% by volume of the working layer.

8. The DEI according to claim 1, wherein the first phase occupies greater than 65% by volume of the working layer and the second phase occupies less than 35% by volume of the working layer.

9. The DEI according to claim 1, further comprising:

an attachment body adapted to attach the DEI to a boring tool.

10. The DEI according to claim 9, wherein the working layer is disposed on the attachment body.

11. The DEI according to claim 9, further comprising:

a transition layer adapted to attach the working layer to the attachment body, wherein the transition layer is disposed on the attachment body.

12. The DEI according to claim 11, wherein the working layer is disposed on the transition layer.

13. A method of forming a Diamond Enhanced Insert (DEI), comprising:

compacting a powder mixture comprising a first phase comprising a plurality of diamond grains and a second phase comprising a catalyst to form a green composite, and sintering the green composite to form a polycrystalline diamond (PCD) material, wherein a fracture toughness of the PCD material is greater than 12.5 MPa·√m, a flexural strength of the material is greater than 800 MPa, and a diamond frame strength of the PCD material is less than 400 MPa.

14. The method according to claim 13, wherein sintering the green composite comprises a high temperature, high pressure process.

15. The method according to claim 13, wherein the green composite is sintered directly on a transition layer to form a working layer of the sintered PCD material disposed on the transition layer.

16. The method according to claim 13, wherein the green composite is sintered directly on an attachment body to form a working layer of the sintered PCD material disposed on the attachment body.

17. The method according to claim 13, wherein sintering the green composite activates the second phase and causes a plurality of inter-diamond-grain bonds to form between the plurality of diamond grains, wherein the inter-diamond-grain bonds impart fracture toughness, transverse rupture strength, and diamond frame strength to the PCD material.

18. The method according to claim 17, wherein the plurality of inter-diamond grain bonds impart a fracture toughness of greater than 12.5 MPa·√m, a transverse rupture strength of greater than 800 MPa, and a diamond frame strength of less than 400 MPa and greater than 100 MPa.

19. The method according to claim 17, wherein a quantity of the plurality of inter-diamond-grain bonds is set by a ratio of the first phase to the second phase.

* * * * *